US009174240B1

(12) United States Patent
Wilson

(10) Patent No.: US 9,174,240 B1
(45) Date of Patent: Nov. 3, 2015

(54) MATERIAL SORTER APPARATUS

(71) Applicant: David L. Wilson, Glendale, AZ (US)

(72) Inventor: David L. Wilson, Glendale, AZ (US)

( * ) Notice: Subject to any disclaimer, the term of this patent is extended or adjusted under 35 U.S.C. 154(b) by 156 days.

(21) Appl. No.: 13/856,780

(22) Filed: Apr. 4, 2013

Related U.S. Application Data

(60) Provisional application No. 61/621,449, filed on Apr. 6, 2012.

(51) Int. Cl.
*B07B 1/24* (2006.01)

(52) U.S. Cl.
CPC ..... *B07B 1/24* (2013.01)

(58) Field of Classification Search
USPC ..... 209/284, 288, 289, 294, 296, 297
See application file for complete search history.

(56) References Cited

U.S. PATENT DOCUMENTS 5,108,584 A * 4/1992 Brosseuk ..... 209/44
6,360,894 B1 * 3/2002 Devlin et al. ..... 209/291
6,827,222 B1 * 12/2004 Nilsson ..... 209/284

* cited by examiner

*Primary Examiner* — Terrell Matthews
(74) *Attorney, Agent, or Firm* — Thomas W. Galvani, P.C.; Thomas W. Galvani

(57) ABSTRACT

A material sorter apparatus includes a drum mounted for rotation and a coaxial trommel mounted within the drum. Raw material is applied to the trommel. Rotational movement of the drum imparts expulsion of large material in the raw material from the trommel out of the device. The rotational movement of the drum imparts filtration of the raw material through the trommel into the drum as fine material. The drum is fluid impervious and is formed with an inwardly-directed lip. The trommel and drum are angled with respect to a horizontal. A wash is directed into the drum to wash the raw and fine material in the trommel and drum. The drum is mounted for pivotal movement to a stand.

20 Claims, 6 Drawing Sheets

MATERIAL SORTER APPARATUS

CROSS-REFERENCE TO RELATED APPLICATIONS

This application claims the benefit of U.S. Provisional Application No. 61/621,449, filed Apr. 6, 2012.

FIELD OF THE INVENTION

The present invention relates generally to prospecting equipment, and more particularly to prospecting equipment for sorting material.

BACKGROUND OF THE INVENTION

Historically, prospecting for precious metals has been a laborious pursuit for income. In recent times, prospecting has evolved into a venture typically undertaken by two different sorts: industrial operators and enthusiastic hobbyists. The mining industry, and the gold-mining industry in particular, has developed high technology-driven methods of location and extraction to leverage economies of scale and massive budgets. Hard-rock mining of lode deposits produces a large amount of the world's commercial gold and occurs in open-pit or underground mines using explosives to release rock embedded with gold. The rocks are crushed into a slurry, and a chemical leaching and electrowinning process purifies the gold.

Hobbyists, on the other hand, do not have the financial resources to take on large-sized installation prospecting work, and so typically will instead rove from site to site exploring for precious metals. Due largely to financial and portability considerations, hobbyists use tools and methods very similar to those first used in prospecting, and the manual labor associated with the effort has diminished little. Because most of the tools prospectors use have not changed greatly, the process of searching, classifying, and panning for precious metals is still a difficult task involving a great deal of digging, heavy lifting, stooping and bending over, and shaking dirt. Additionally, modern prospecting tools still require that the prospector first classify "raw" material and then filter gravel and debris from the fine materials before panning the fine material.

Modern prospectors often use metal detectors to help locate gold deposits. Once a site has been located, the prospector will prepare the site with equipment such as a shovel, a classification screen, and a gold pan. The prospector begins by digging up raw material such as dirt and gravel from the site, placing it on top of the classification screen, and shaking the screen, which filters the smaller rocks from the larger rocks. Three to four shovel-fulls of dirt can be classified at once, depending on the size of the classification screen. The larger rocks are discarded, and the remaining loose material and gravel can be panned. Material is placed into a pan. The prospector fills the pan with water or dips it into a river, and shakes, vibrates, or gyrates the pan to slosh water about inside the pan. At most pressures and temperatures, water is typically 1 gram per per cubic centimeter in density, rocks and gravel vary between 2 to 3 grams per cubic centimeter, and gold is 19.3 grams per cubic centimeter, and so this process allows the denser gold to settle to the bottom of the pan and the lighter materials to move to the top where they can be skimmed off and removed. Repeated shaking and skimming eventually leaves the dense materials at the bottom. If gold was in the pan initially, the gold will have settled near the bottom of the pan after this process has been repeated many times.

While panning is an effective means of filtering dense material from less dense, it can only be used to process a limited amount of fine material at once. Some prospectors use a sluice box to process a large amount of raw material. With a sluice box, a prospector can dump one shovelful of raw material after another into the upstream end of the sluice box, and riffles, or baffles along the bottom of the sluice box, trap gold as the water and raw material flow by. However, the classification step is still necessary when using a sluice box, as larger rocks will not be carried through the sluice box, but will instead come to rest on top of it, creating turbulence and vortices that can lessen the effectiveness of the sluice box at trapping fine gold. These processes are time-consuming because each requires several steps to reduce the raw material to pannable fine material, and thus little volume of raw material can be processed quickly.

SUMMARY OF THE INVENTION

According to the principle of the invention, a material sorter apparatus simultaneously classifies and pans raw material into fine, dense material. The material sorter apparatus includes a drum, and a coaxial trommel mounted within the drum. Raw material is applied to the trommel, and movement of the drum imparts movement to the trommel, which expels large material in the raw material from the trommel. The movement of the drum also imparts filtration of the raw material through the trommel into the drum as fine material. The movement of the drum also pans the fine material in the drum, separating dense material from light material. Any gold in the raw material will be finally deposited in the dense material in the drum.

BRIEF DESCRIPTION OF THE DRAWINGS

Referring to the drawings.

DETAILED DESCRIPTION

Figure 1:
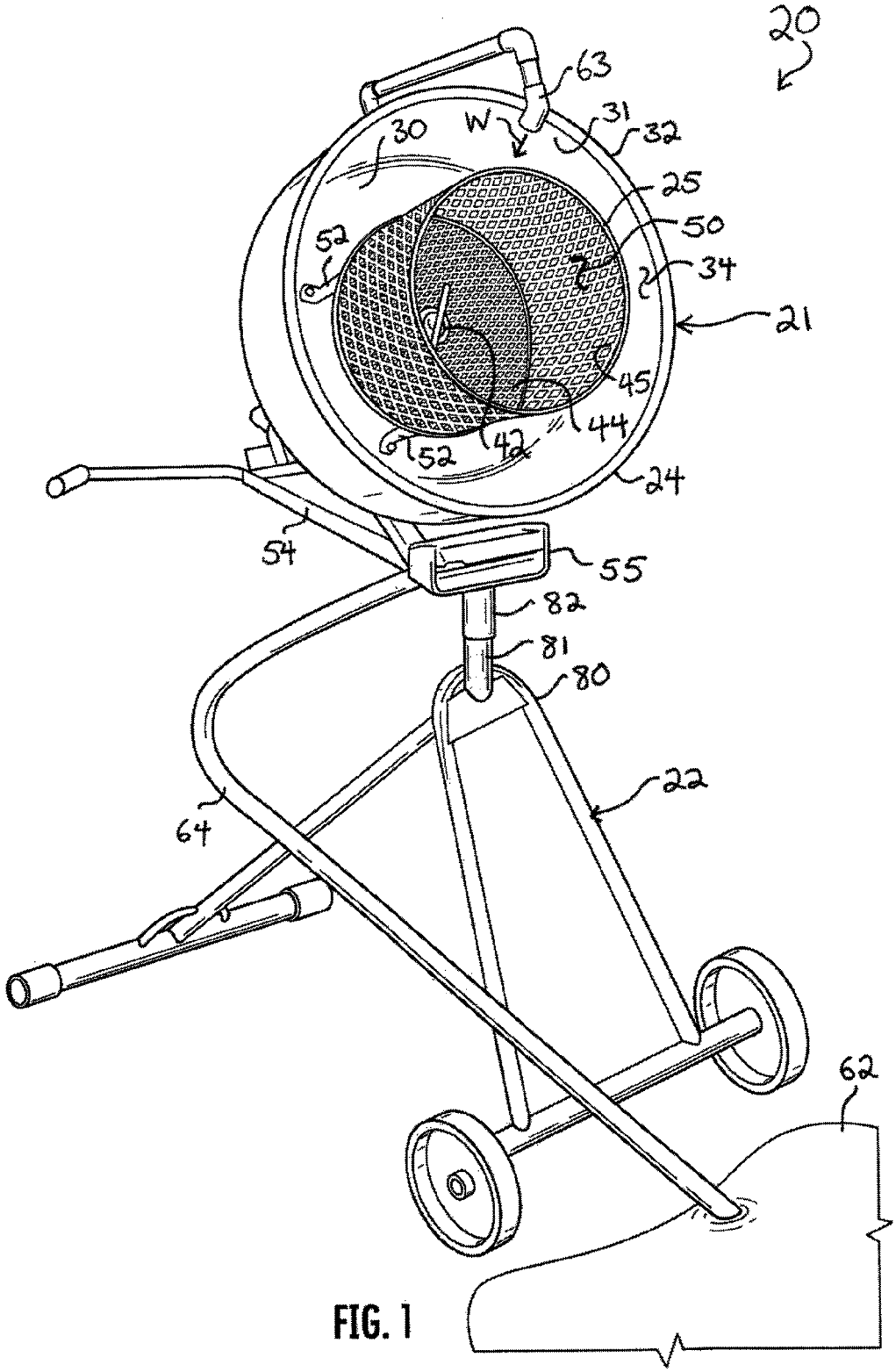
FIG. 1 is a front perspective view of a material sorter apparatus constructed and arranged according to the principle of the invention, illustrating a trommel, a drum, a piping assembly, and a stand.

Reference now is made to the drawings, in which the same reference characters are used throughout the different figures to designate the same elements. FIG. 1 illustrates a material sorter apparatus 20 constructed and arranged in accordance with the principle of the invention, and which is useful to a prospector for simultaneously classifying and panning raw material. The term "prospector" will be used herein to designate any person operating the material sorter apparatus 20. The material sorter apparatus 20 includes a sorter head 21 mounted for rotation at an elevated position on a stand 22. The sorter head 21 includes an outer panning drum 24 and an inner classifying trommel 25.

Figure 2:
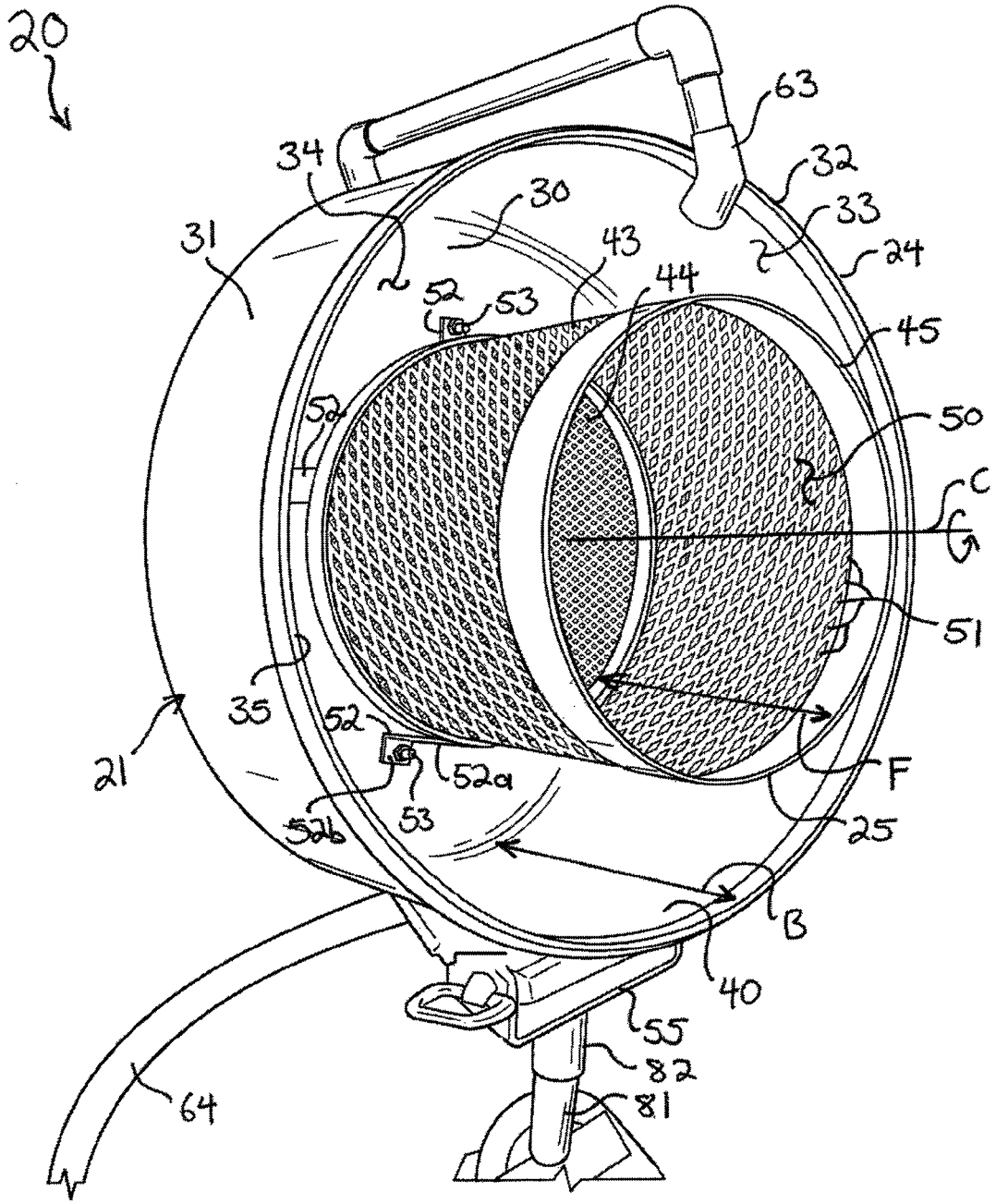
FIG. 2 is an enlarged front perspective view of the trommel, drum, and piping assembly of the material sorter apparatus of FIG. 1.

FIG. 2 illustrates the drum 24 and trommel 25 in greater detail. The drum 24 includes an endwall 30 and a cylindrical sidewall 31 extending from the endwall 30 to a circular open front 32 of the drum 24. The endwall 30 defines a back of the drum 24 which is opposed from the open front 32. The endwall 30, sidewall 31, and open front 32 cooperate to define a cylindrical interior volume 34 extending within the drum 24 from a circular opening 33. An annular, inwardly-directed lip 35 is formed continuously along an inner surface 40 proximate to the front 32 of the drum 24. The inner surface 40 extends continuously across the endwall 30 and the sidewall 31, is contoured between the endwall 30 and the sidewall 31, and is a smooth surface. The lip 35 is a ridge formed to the inner surface 40 of the drum 24. In a preferred embodiment, the lip 35 is integrally formed to the inner surface 40, such as by molding or welding, and in other embodiments, as one having ordinary skill in the art will readily appreciate, the lip 35 is a band of metal press-fit into the drum 24 at the front 32.

Figure 6:
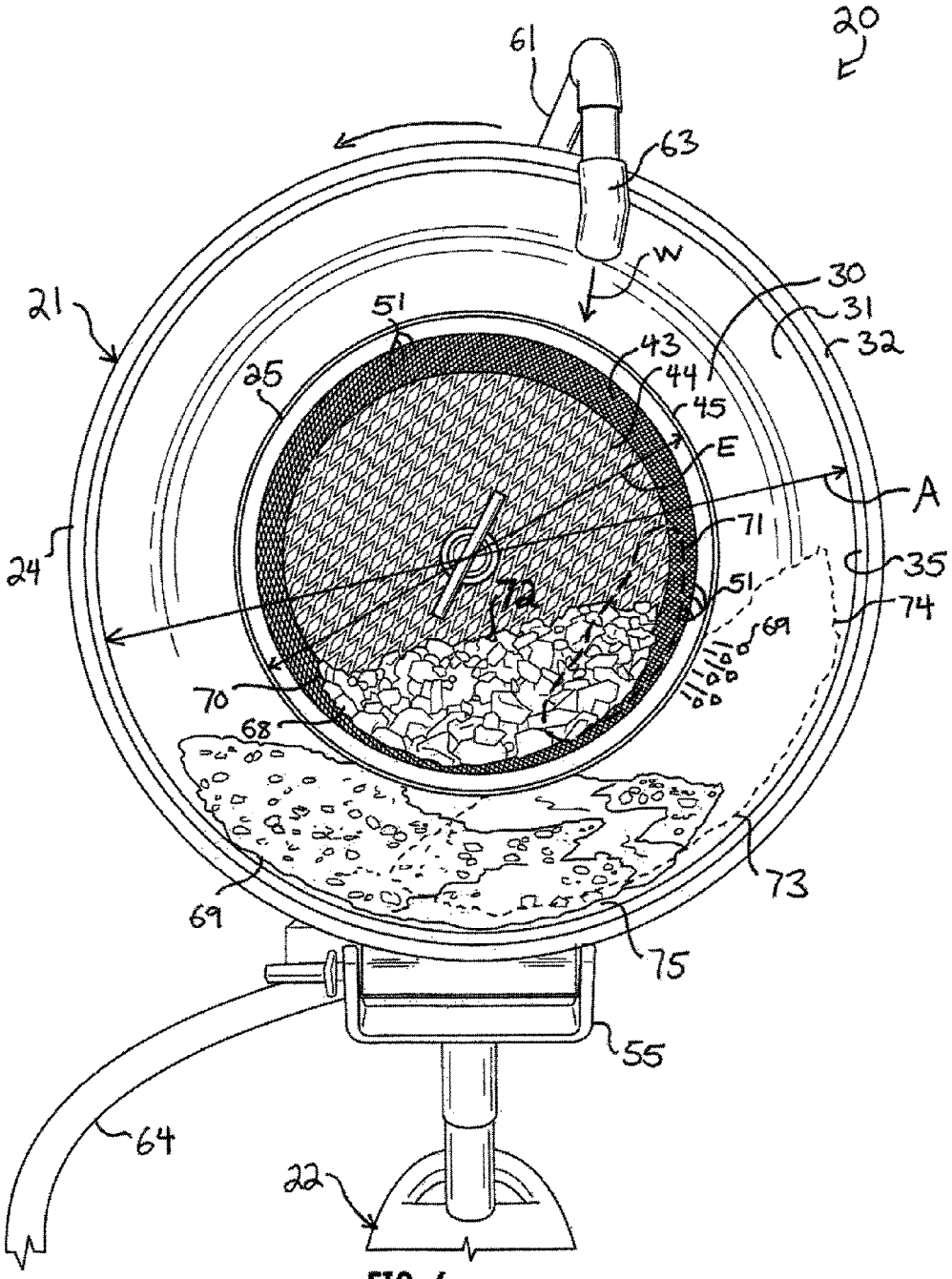
FIG. 6 is a front elevation view of the trommel and drum of the material sorter apparatus of FIG. 1.

The drum 24 is fluid impervious and is constructed of a material or combination of materials which have rugged, durable, rigid, and resilient material characteristics, such as heavy-grade plastic or metal. The drum 24 has a substantially uniform diameter A, as shown in FIG. 6, which is constant from the endwall 30 to the front 32 across the drum 24. The diameter A is approximately 24 inches (approximately 61 centimeters). The drum 24 also has a depth B, shown in FIG. 2, between the front 32 to the endwall 30, which is approximately 11 inches to approximately 14 inches (approximately 27.94 centimeters to approximately 35.6 centimeters). These dimensions are suitable for material sorter apparati used by one or a few prospectors using shovels and the like to prospect; in larger operations, a material sorter apparatus having larger dimensions may be preferable. Further, though the sidewall 31 of the drum 24 is preferably cylindrical, in other embodiments, the sidewall 31 has other shapes such as prismatic or triangular.

Figure 3:
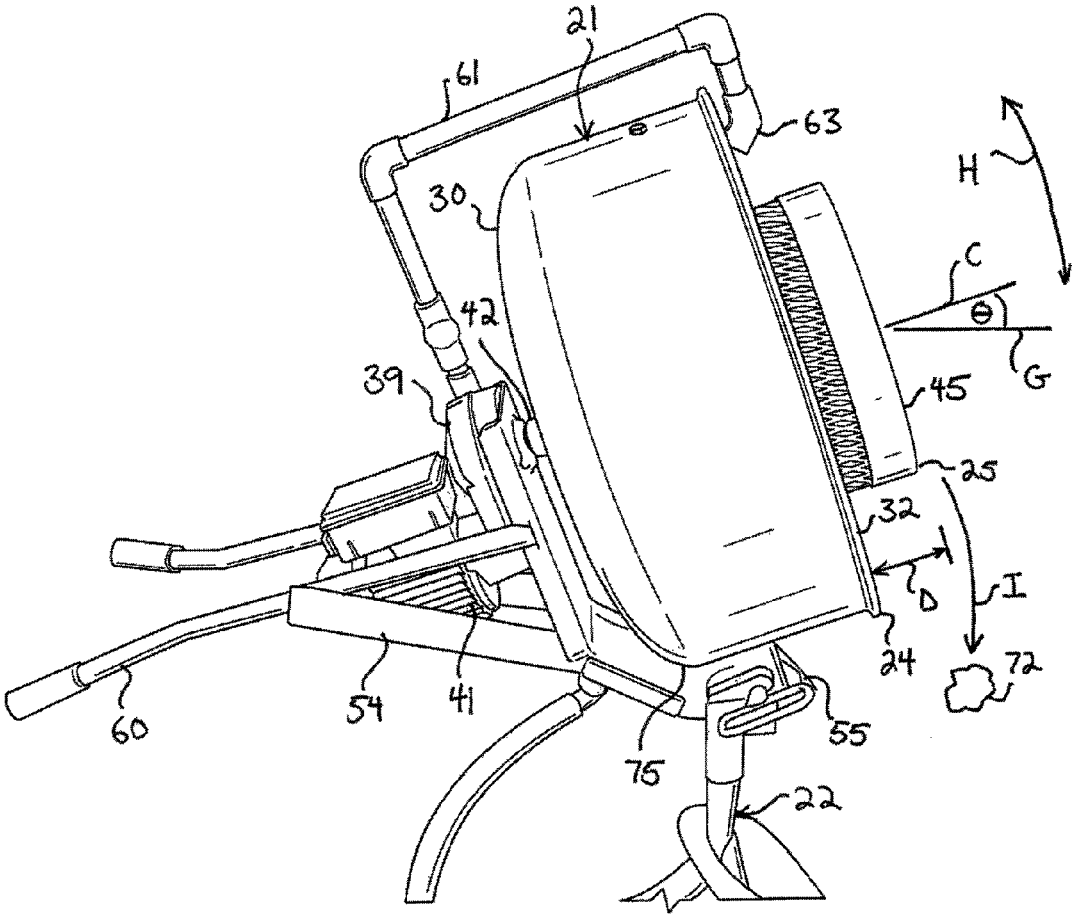
FIG. 3 is a side elevation view of the trommel, drum, and piping assembly of the material sorter apparatus of FIG. 1, and showing a motor mounted to the frame.

Turning now to FIG. 3, the drum 24 is mounted to a motor 41 for rotation about an axis C. One having ordinary skill in the art will readily appreciate that the motor 41 may be a gas-powered motor or an electrically-driven motor, as the prospector prefers or as the situation requires. The drum 24 is fixed to a rotating shaft 42 extending from the motor 41 proximate to the endwall 30. The shaft 42 extends through the endwall 30 of the drum where the shaft 42 is bolted, compressively securing the drum 24 and the trommel 25 on the shaft 42, as seen in FIG. 1. The motor 41 is coupled to the shaft 42 through a gearbox 39 between the motor 41 and the shaft 42 and behind the endwall 30.

With reference again to FIG. 2, the drum 24 carries the trommel 25, which is co-axially mounted to the drum 24 for rotation with the drum 24 about axis C. The trommel 25 has a permeable, cylindrical sidewall 43, a permeable endwall 44, and an opposed open circular front 45 or mouth for receiving and expelling material from an interior volume 50 bound and defined between the sidewall 43, endwall 44, and front 45. The endwall 44 defines a back of the trommel 25. With brief reference to FIG. 3, the front 45 of the trommel 25 projects beyond the front 32 of the drum 24 by a distance D. Returning to FIG. 2, the sidewall 43 and endwall 44 of the trommel 25 are formed with a plurality of openings 51 through both the sidewall 43 and endwall 44. Preferably, the sidewall 43 and endwall 44 are both constructed of a mesh screen commonly known in the art as half-inch mesh, the characteristics of which include preventing material larger than half an inch in dimension from passing through the openings 51 in the mesh. One having reasonable skill in the art will readily appreciate, though, that mesh with larger or smaller openings 51 may be used depending on the nature and needs of the use and the site being prospected.

As shown in FIG. 6, the trommel 25 has a substantially uniform diameter E which is constant from the front 45 to the end wall 44 across the trommel 25 and is approximately 14 inches (approximately 35.6 centimeters). As shown in FIG. 2, the trommel 25 has a depth F from the front 45 to the endwall 44, which is approximately 14 inches (approximately 35.6 centimeters). One having ordinary skill in the art will readily appreciate that these dimensions are not rigid and may vary depending on the nature and needs of the use and the size of the material to be prospected. Moreover, though the trommel 25 is preferably cylindrical, the trommel 25 could be another size or shape such as prismatic or triangular.

As seen in FIG. 2, the endwall 44 of the trommel 25 is mounted to the drum 24 and is spaced apart from the endwall 30 of the drum 24. Brackets 52 extending from the endwall 44 secure the trommel 25 to the inner surface 40 of the endwall 30 of the drum 24. The brackets 52 space the endwall 44 approximately 5 inches (approximately 12.7 centimeters) apart from and in front of the endwall 30 of the drum 24. The brackets 52 are L-shaped and have an upper portion **52*a* and a lower portion 52*b* extending perpendicularly to the upper portion 52*a* and radially outwardly from the trommel 25. The upper portion 52*a* is permanently fastened, as by a weld, to the trommel 25 proximate to the endwall 44. A fastener 53, such as a bolt, extends through the lower portion 52*b* and through the endwall 30 of the drum 24, securing the lower portion 52*b* to the endwall 30 and securing and rigidly fixing the trommel 25 to the drum 24. The trommel 25** is fluid pervious and is constructed of a material or combination of materials which have material characteristics of ruggedness, durability, rigidity, and resiliency, such as metal.

Together, the drum 24 and trommel 25 form the sorter head 21. As shown in FIG. 3, the sorter head 21 is mounted on a frame 54 which is supported by the stand 22. The frame 54 is a structural support which carries and supports the motor 41 behind the sorter head 21, and the sorter head 21 is secured to the shaft 42 projecting from the motor 41. Supported by the frame 54 on the stand 22, the sorter head 21 is held at an elevated position with respect to the ground. The frame 54 is mounted for pivotal movement to the stand 22 so that the sorter head 21 moves through a range of pivotal motion throughout which the sorter head 21 can be selectively set and locked, setting the sorter head 21 at an angle θ with respect to a horizontal G, as indicated in FIG. 3.

Figure 4:
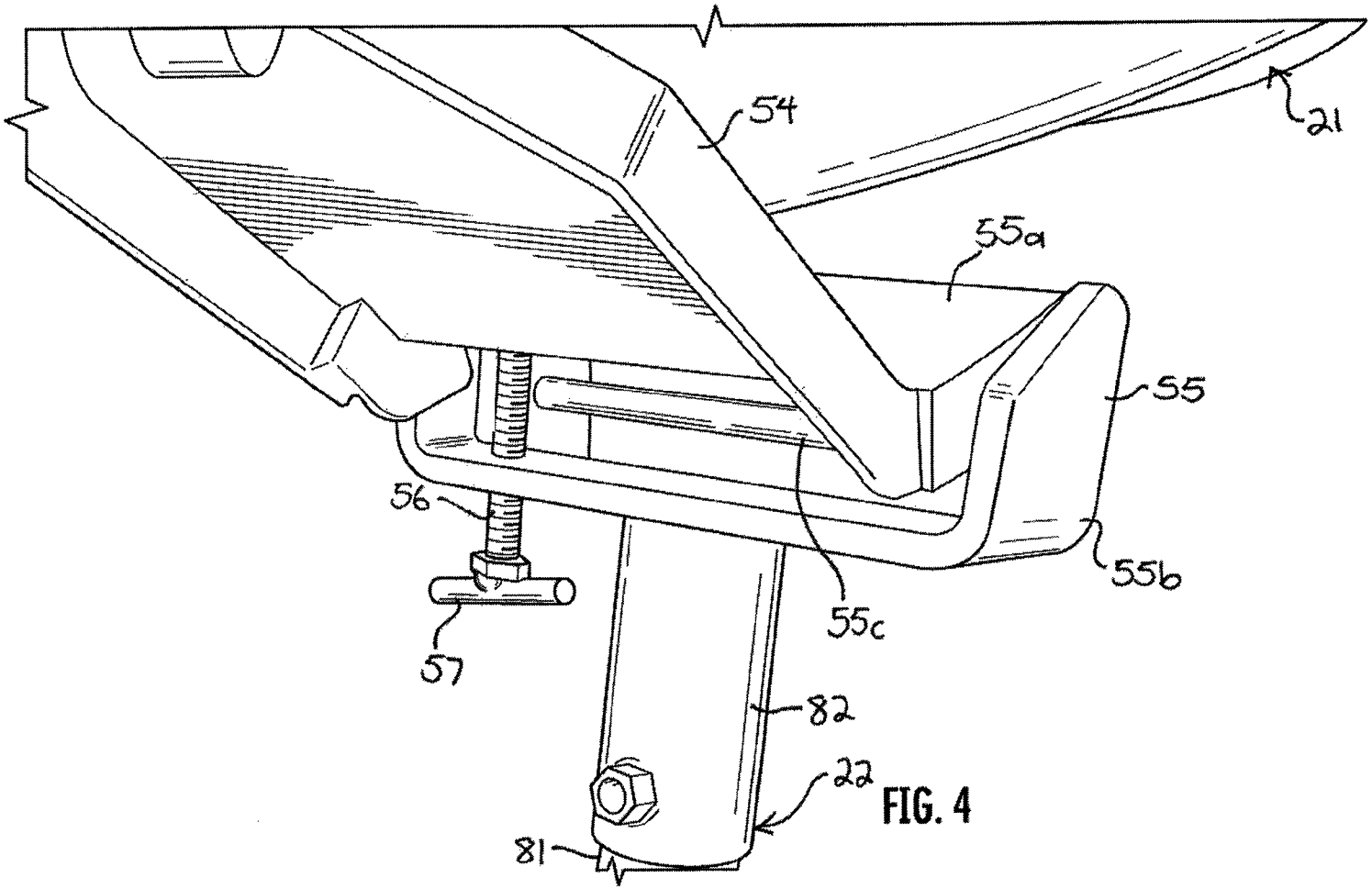
FIG. 4 is a bottom perspective view of a hinge in the stand below the drum of the material sorter apparatus of FIG. 1.

A hinge 55 is formed between the frame 54 and the stand 22. Referring now to FIG. 4, a lower end of the frame 54 forms an upper leaf or wing **55*a* of the hinge 55, and a lower wing 55*b* of the hinge 55 is carried on the top of the stand 22. A pin 55*c* through the upper and lower wings 55*a* and 55*b* couples the upper and lower wings 55*a* and 55*b*, and the sorter head 21 pivots about the pin 55*c* with respect to the stand 22. A set screw 56 extends through the lower wing 55*b* upwardly into the underside of the upper wing 55*a* and is threadably engaged with the lower wing 55*b*. Clockwise and counterclockwise rotational adjustment of the set screw 56 causes the upper and lower wings 55*a* and 55*b* to move closer and further apart, causing the hinge 55 to contract and expand, respectively, and causing the angle θ of the sorter head 21 with respect to the horizontal G to decrease and increase, respectively. The set screw 56 has an enlarged head 57 to aid in gripping of the set screw 56** during rotation.

Returning to FIG. 3, the sorter head 21 pivots in the direction generally indicated by the double-arrowed line H, moving between a level position in which axis C is generally parallel to the ground and the horizontal G, which is normal to the stand 22, and a tilted position in which axis A is transverse to the horizontal G, and the fronts 32 and 45 of the drum 24 and trommel 25 are directed upwards at an angle of approximately 45 degrees. An elongate, tubular handle 60 extending backward from the framework 54 allows for precise pivoting of the sorter head 21. Operation of the material sorter apparatus 20 preferably takes place when the sorter head 21 is angled so that the rotational axis C forms a relatively small, acute angle with respect to the horizontal G of approximately 10 to 20 degrees, as shown in FIG. 3, and so that the front end 45 of the trommel 25 extends further along the horizontal G than the front end 32 of the drum 24.

In operation, the material sorter apparatus 20 is useful for quickly and simultaneously classifying and panning a large volume of raw material. The material sorter apparatus 20 can be disassembled and assembled for portability. The various parts of the material sorter apparatus 20 are light enough to be carried by a single prospector, so that the material sorter apparatus 20 can be taken deep into the wilderness and set up quickly and easily for remote prospecting. Once set up at a potential site, the prospector activates the motor 41, rotating the sorter head 21. The sorter head 21 is preferably rotated at a speed of approximately 24 revolutions per minute. In some instances, a faster or slower rate of rotation is more effective at classifying and filtering raw material. Dry or sandy raw material can be rotated much more quickly (above 24 RPM), while moist raw material is generally rotated at slower speeds (below 24 RPM). However, the rotational speed is kept below a speed at which the centrifugal force produced would overcome gravity and cause the raw material to be pressed against the sidewall 31, preventing relative annular or circumferential movement of the raw material and the sidewall 31. As stated above, the motor 41 is either gasoline or electrically powered, whether AC or DC, and the sorter head 21 can be driven by other means as well, such as by hand or foot cranking, though the embodiment shown in these FIGS. shows the preferred embodiment including a motor 41. In a gas-powered motor, the rotational speed is controlled by the motor 41 itself, and in an electrical motor 41, the rotational speed is controlled by a speed controller coupled to the motor 41.

The material sorter apparatus 20 is operated in one of either a wet or dry operating condition. The FIGS. illustrate an embodiment ready for use in a wet operating condition but which can also be run in a dry operating condition. In FIG. 1, a piping assembly 61 extends behind and above the sorter head 21, is coupled in fluid communication to a fluid source 62, and terminates in an outlet 63 directed inwardly into the drum 24. The fluid source 62 shown in FIG. 1 is a local water source such as a pond or puddle, and is not necessarily a source of clean or potable water, but one having ordinary skill in the art will readily appreciate that the fluid source 62 can also be a fresh supply of water as from a stream or a hose coupled to a spigot. Generally, a pump (not pictured) will be coupled to the piping assembly 61 to draw water into the piping assembly 61 from the fluid source 62.

Figure 5:
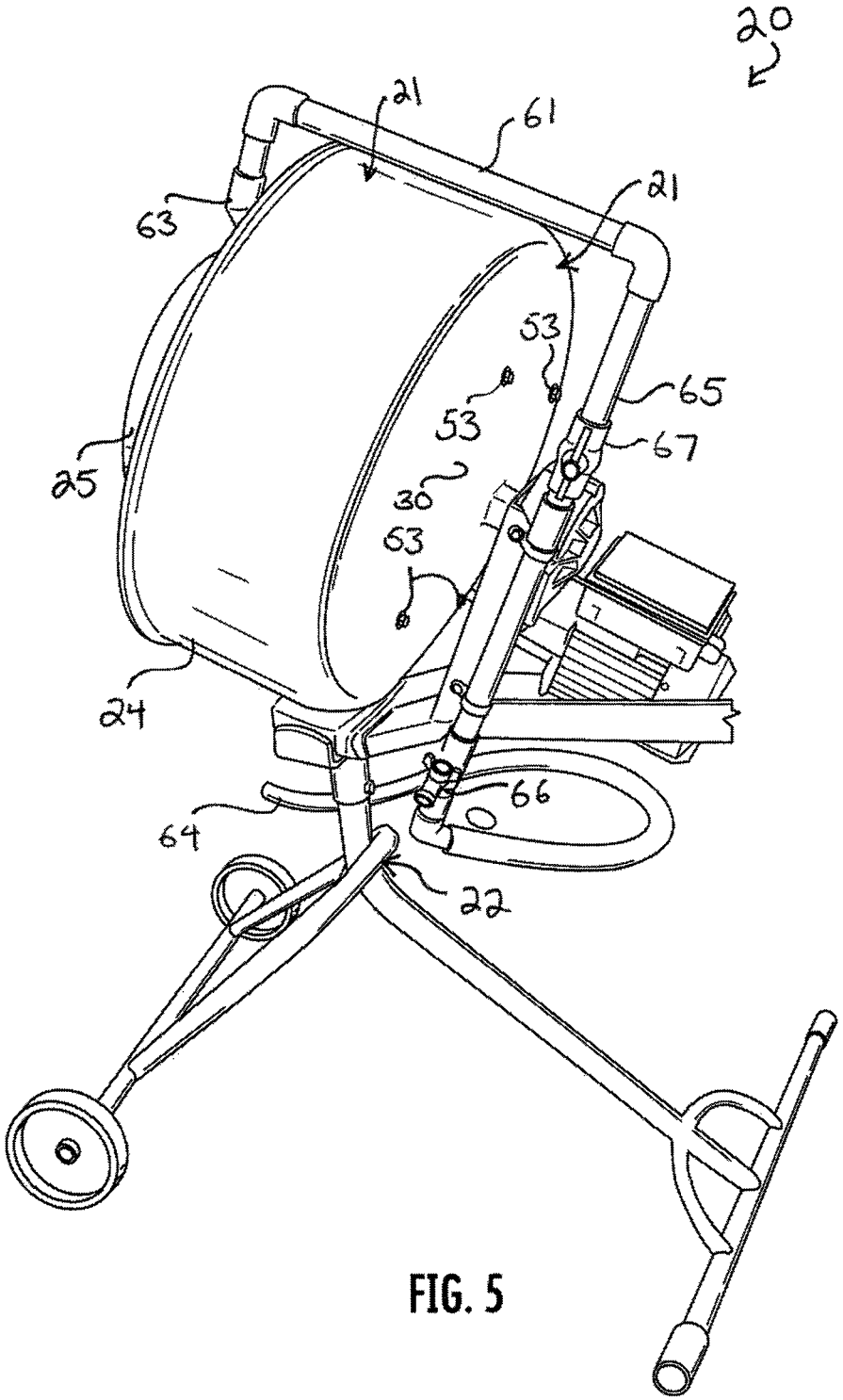
FIG. 5 is rear perspective view of the material sorter apparatus of FIG. 1.

Shown in FIG. 5, the piping assembly 61 includes a flexible hose 64 at a distal end of the piping assembly 61 coupled in fluid communication to a pipe 65. The pipe 65 extends behind the endwall 30 of the drum 24 and includes a spigot 66 for connecting to a fluid source and a shut-off valve 67 for controlling the movement of water through the piping assembly 61. The pipe 65 angles over the drum 24 and terminates at the inwardly-directed outlet 63.

Water is applied to the piping assembly 61 to expel a wash W of water into the drum 24, as shown in FIG. 1. Turning on the pump (or supplying water to the spigot 66) communicates water through the piping assembly 61 and out the outlet 63, where the water is discharged as the wash W onto the sidewall 43 of the trommel 25 and into the interior volumes 50 and 34 of the trommel 25 and the drum 24, respectively. The wash W breaks up raw material applied to the drum 24 and to the trommel 25.

Rotation of the sorter head 21 imparts synchronous rotation of the drum 24 and the trommel 25 in a counter-clockwise direction about axis C, as shown in FIG. 2. The prospector begins digging raw material from the site and loading the raw material into the material sorter apparatus 20 at the front 45 of the trommel 25. As the term is used here, "raw material" is meant to include material taken directly from the Earth, whether it is rock, clay, soil, dirt, sand, snow, ice, water, or some other like substance or mixture, and is identified with the reference character 68. Raw material 68 is distinct from large material, fine material, and dense material, which terms will be defined herein. Raw material 68 is initially applied to and contained in the interior volume 50 of the trommel 25, such as by the prospector digging the raw material from the ground with a shovel and shoveling it into the trommel 25. Rotation of the trommel 25 engenders relative annular or circumferential motion between the trommel 25 and the raw material 68; as the trommel 25 rotates, the raw material 68 moves from a lower position, indicated with reference character 70 in FIG. 6, to a raised position, indicated in dotted line in FIG. 6 with the reference number 71, on the right-hand side of the trommel 25, which is a trailing side of the rotation of the trommel 25. As the trommel 25 rotates, the raw material repeatedly and continuously rises, falls, and tumbles upon itself from the raised position 71 to the lower position 70. The wash W breaks up groups of rocks, breaks up clumps of clay and dried mud, and helps release smaller debris from larger debris in the raw material 68 in trommel 25.

Finer, denser parts of the raw material 68 move toward the sidewall 43 of the trommel 25, urged in that direction by centrifugal force, density, and the wash W of water from the outlet 63. Fine material 69 is filtered, passing through the openings 51 in the mesh surface of the sidewall 43, so that the fine material 69 is deposited into the rotating drum 24. Large material 72 which is larger and less dense than the fine material 69, which is larger than the size of the openings 51, rises to the top of the tumbling pile in the trommel 25 or is expelled out the front 45 of the trommel 25. As shown in FIG. 3, the front 45 of the trommel 25 extends beyond the front 32 of the drum 24, so that large material 72 which is expelled out the front 45 of the trommel 25 falls downward generally along line I, clearing the drum 24. Large material 72 may fall onto the ground or into a collection bucket below the sorter head 21.

The angle θ of the sorter head 21 with respect to the horizontal G causes large material 68 expelled out the front 45 of the trommel 25 to not fall back into the sorter head 21. That angle of tilt is adjustable within a range of effectiveness; an angle too steep (such as above approximately 40 to 45 degrees) will not allow large material 68 to spill out the front 45, while an angle too shallow (such as below approximately 10 degrees), or a negative angle, will spill too much large material and not allow raw and fine material 68 and 69 to be retained within the trommel 25. The large material 68 is ejected out the front 45, medium-sized material is left in interior volume 50 of the trommel 25, and fine material 69 filters through the trommel 25 into the drum 24. Returning to FIG. 6 now, raw material 68 which is left in the trommel during rotation is generally unwanted material. This unwanted material includes gravel, debris, and rocks larger than one-half inch in dimension and which has a low density.

The fine material 69 is washed and falls through the openings 51 of the sidewall 43 of the trommel 25 and into the drum 24 in response to the relative motion between the trommel 25 and the raw material 68. The fine material 69 that filters through to the drum 24 includes dense material 73 and light material 74. Just as the raw material 68 tumbles in the trommel 25, so too does the fine material 69 tumble in the drum 24, so that the dense material 73 sinks and the light material 74 rises. The lip 35 on the inner surface 40 of the drum 24 helps retain the dense material 73 inside the drum 24. As more and more raw material 68 is added to and classified by the trommel 25, additional fine material 69 is deposited within the drum 24. After many shovel-fulls of raw material 68 are loaded into the trommel 25, the amount of fine material 69 in the drum 24 is substantial. Much of this fine material 69 is unwanted and can be screened off by skimming the top layer with a hand, arm, or flat piece of wood, leaving the densest, smallest, and finest dense material 73 below. More raw material is continuously added to the trommel 25 and classified down to the drum 24.

The water washing from the fluid supply line 61 washes through the trommel 25 into the drum 24, serving to break up clumps of clay and mud that may contain fine bits or flakes of dense material 73. The continuous, fluid impervious sidewall 31 of the drum 24 contains water from the wash W, and because the drum 24 is rotating, the continuous tumbling of fine material 69 in the water in the drum 24 causes the fine material 69 and water to become a slurry. The rotation of the drum 24 pans the slurry, and the panning causes the dense material 73 to sink in the slurry with respect to the light material 72 in the slurry. The dense material 73 sifts through the slurry of fine material mixture to a bottom 75 of the drum 24, which, because the sorter head 21 is tilted at an angle, is located along the sidewall 30 proximate to the endwall 30 of the drum 24. Gold has a high density and will fall to the bottom 75 of the drum 24 and away from the front 32 of the drum 24, while the light material 74 will rise to the top and front of the pile, where the light material 74 can be continually screened off. The largest and lightest parts of the fine material 74 which are not screened off will spill or be expelled over the lip 35 out the front 32 of the drum 24.

The material sorter apparatus 20 allows a prospector to sort through a large amount of raw material 68. A prospector manually panning for gold using old techniques can process several hundred pounds of material per day, while a single prospector using the material sorter apparatus 20 reasonably processes 3 to 5 tons per day, and up to 10 tons per day. When a prospector has finished processing the raw material 68, the material sorter apparatus 20 is turned off, ending rotation of the sorter head 21 and the movement of the wash W of water through the piping assembly 61, and the dense material 73 comes to a rest in the bottom 75 of the drum 24. Several tons of raw material 68 efficiently yield only a few dozen pounds of dense material 73 in the drum 24. If gold was in the raw material, then the color of gold may be present in this dense material 73 so that a prospector can directly pull the gold from the dense material 73, or the prospector may choose to manually pan the few pounds of dense material 73 in a final step according to known panning methods.

The above operation has been described in accordance with running the material sorter apparatus 20 in a wet operation mode. The material sorter apparatus 20 may also be run in a dry operation mode, simply by proceeding through the steps described above without supplying water to the piping assembly 61. A prospector may prefer to run the material sorter apparatus 20 in a dry operational mode to avoid producing mud or because he or she may not have access to water. Without water, raw material 68 is still loaded into trommel 25, where the raw material 68 is classified as the sorter head 21 rotates about axis A. Fine material 69 filters into the drum 24, where the fine material 69 spins, rises along the inner surface 40 of the drum 24, and tumbles back to the bottom 75 of the drum, moving in a fluid fashion. In this way, dense material 73 sinks to the bottom 75 of the drum 24, and light material 74 is ejected out the front 32 of the drum 24 to fall on the ground below the material sorter apparatus 20.

There are various methods of transporting and supporting the material sorter apparatus 20. As described above, the material sorter apparatus 20 includes a stand 22 so that the sorter head 21 is supported at an elevated position above the ground, which provides a great deal of room below the sorter head 21 for discarded material to fall. With reference to FIG. 1, the stand 22 includes a base 80 having a vertical post 81, the hinge 55, and a sleeve 82 secured to the underside of the hinge 55 receiving the post 81 of the base 80 and supporting the hinge 55 thereon. The stand 22 is constructed of a material or combination of materials which have material characteristics of ruggedness, durability, rigidity, and resiliency, such as metal. The stand 22 can be disassembled, with the sleeve 82 sliding off of the post 81 so that the frame 54 and the sorter head 21 can be carried and moved. If desired, the sorter head 21 can be positioned on a cylindrical post on a truck's trailer hitch. Alternatively, a trailer or cart might have several vertical posts for receiving several sorter heads 21.

The present invention is described above with reference to a preferred embodiment. However, those skilled in the art will recognize that changes and modifications may be made in the described embodiment without departing from the nature and scope of the present invention. To the extent that such modifications and variations do not depart from the spirit of the invention, they are intended to be included within the scope thereof.

Having fully and clearly described the invention so as to enable one having skill in the art to understand and practice the same, the invention claimed is:

1. A device comprising:

a drum;

a coaxial trommel mounted within the drum, the trommel having an open front, an opposed closed back, and an axis of rotation extending upwardly from the back to the front; and raw material applied to the trommel;

wherein movement of the drum imparts expulsion of large material in the raw material from the trommel out of the front of the trommel; and movement of the drum imparts filtration of the raw material through the trommel into the drum as fine material; and wherein the back of the trommel is rigidly fixed to the back of the drum; and wherein the diameter of the drum is greater than the depth of the drum.

2. The device according to claim 1, wherein the drum is formed with an inwardly-directed lip.

3. The device according to claim 1, wherein the trommel and drum are angled with respect to a horizontal.

4. The device according to claim 1, wherein:

the trommel has a back;

the drum has a back;

the back of the trommel is rigidly fixed to the back of the drum; and the back of the trommel is spaced apart from the back of the drum.

5. The device according to claim 1, wherein the drum is fluid impervious.

6. The device according to claim 5, further comprising a wash directed into the drum.

7. The device according to claim 1, wherein the drum is formed with an inwardly-directed lip bounding an open front of the drum.

8. The device according to claim 1, wherein the drum is mounted to a stand.

9. The device according to claim 8, wherein the drum is mounted for pivotal movement to the stand.

10. A device comprising:

a drum mounted for rotation;

a trommel carrying raw material, the trommel having an open front, an opposed closed back, and an axis of rotation extending upwardly from the back to the front, and the trommel mounted to the drum for rotation with the drum;

rotation of the trommel engenders relative motion between the trommel and the raw material in the trommel;

relative motion between the trommel and the raw material in the trommel filters fine material from the raw material into the drum; and rotation of the drum pans dense material from the fine material in the drum; and wherein the back of the trommel is rigidly fixed to the back of the drum; and wherein the diameter of the drum is greater than the depth of the drum.

11. The device according to claim 10, wherein the drum and trommel are coaxial.

12. The device according to claim 10, wherein the drum has an open front.

13. The device according to claim 10, wherein the trommel is rigidly fixed to the drum.

14. The device according to claim 10, wherein the drum is fluid impervious.

15. The device according to claim 14, further comprising a wash directed into the drum.

16. A device comprising:

a drum mounted for rotation, the drum including a cylindrical sidewall extending between an endwall and an open front;

an inwardly-directed lip is formed in the open front of the drum;

a trommel mounted to the drum for rotation, the trommel including a cylindrical sidewall extending between an endwall of the trommel and an open front of the trommel, and an axis of rotation extending upwardly from the endwall of the trommel to the open front of the trommel;

the trommel is fixed to the endwall of the drum; and the open front of the trommel extends beyond the lip of the drum; and wherein the back of the trommel is rigidly fixed to the back of the drum; and wherein the diameter of the drum is greater than the depth of the drum.

17. The device according to claim 16, wherein the drum has a diameter and a depth;

the diameter of the drum is greater than the depth of the drum;

the trommel has a diameter and a depth;

the depth of the trommel is equal to the diameter of the trommel; and the depth of the drum is equal to the depth of the trommel.

18. The device according to claim 16, further comprising:

a wash directed into the drum; and the drum is fluid impervious.

19. The device according to claim 16, wherein the trommel is coaxial to the drum.

20. The device according to claim 16, wherein the trommel and drum are pivoted to a stand.

* * * * *